United States Patent [19]

Arechavala

[11] 4,214,246

[45] Jul. 22, 1980

[54] CONTINUALLY ADJUSTABLE FREQUENCY ANTENNA

[76] Inventor: Juan M. Arechavala, Diagonal Norte, 825-Buenos Aires, Argentina

[21] Appl. No.: 964,397

[22] Filed: Nov. 29, 1978

[30] Foreign Application Priority Data

Jan. 20, 1978 [AR] Argentina ..... 274490
Jan. 29, 1978 [AR] Argentina ..... 270164

[51] Int. Cl.[2] ..... H01Q 9/00
[52] U.S. Cl. ..... 343/750; 343/900
[58] Field of Search ..... 343/750, 711-715, 343/901, 900, 889

[56] References Cited

U.S. PATENT DOCUMENTS

| | | | |
|---|---|---|---|
| 2,069,513 | 2/1937 | Wolff | 343/750 |
| 3,381,222 | 4/1968 | Gray | 343/750 |

*Primary Examiner*—David K. Moore
*Attorney, Agent, or Firm*—Pollock, Vande Sande & Priddy

[57] ABSTRACT

An antenna for remote and continuous adjustment within a wide frequency range, by variation of the inductance, and hence the length of a small diameter coil, by means of a slide which short circuits the turns thereof, until a full short circuit is reached.

6 Claims, 9 Drawing Figures

CONTINUALLY ADJUSTABLE FREQUENCY ANTENNA

The antenna according to the present invention is designed to facilitate continuous precise and remote adjustment of its tuning within a wide range of frequencies. Its great advantages make it useful especially for mobile radio stations which must be perfectly adjusted to frequencies within a predetermined spectrum. This type of antenna is even more essential for modern equipment having output circuits with transformers of a determinate band and impedance, and which consequently must be adjusted to their antenna and line of tuned transmission.

In order to achieve remote and continuous tuning, the antenna according to the invention essentially has two main parts, i.e., the antenna itself, and the remote control box, which also, if desired, comprises a field meter to monitor the maximum output point, which will consequently be the perfect adjustment point. The antenna is of the continually variable inductive load type with remote control.

The present invention will be better understood by means of the following description and accompanying drawings, wherein several embodiments of the invention are shown for purposes of illustration, and wherein.

Figure 1:
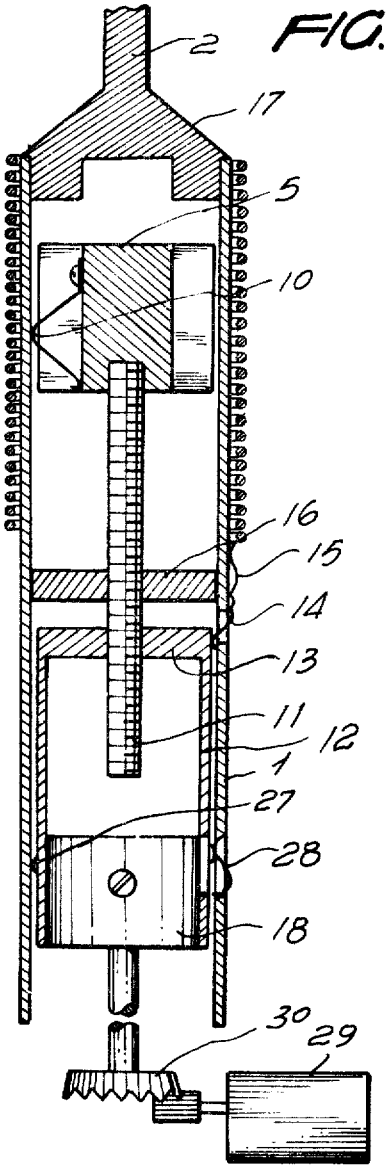
FIG. 1 is a schematic view in a longitudinal section of the antenna of the invention.
Figure 2:
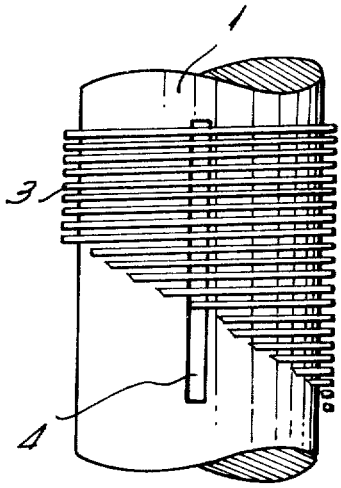
FIG. 2 is an exterior view of the upper part of the antenna.
Figure 7:
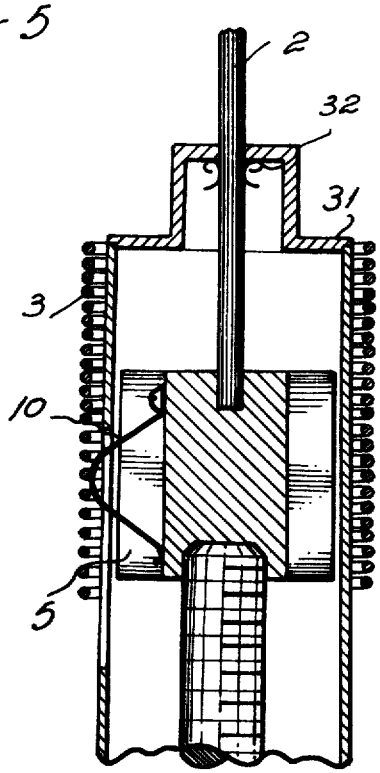
FIG. 7 shows a section of the upper part of the antenna.

The antenna consists of a long insulating tube 1 of appropriate diameter, which by itself may constitute the entire antenna or, may be supplemented at its upper end by a resilient metallic rod, as shown in FIG. 2. This rod can have an automatically variable length, as shown in FIG. 7, or a fixed length, as shown in FIG. 1.

The insulating material tube, preferably of low radio frequency losses for and of high mechanical strength can be constructed of resins and fiberglass, and supports on its upper portion, constituting less than the total length of the tube, a copper wire winding 3 bare and slightly spaced, or else an enameled wire with closed turns, according to the frequency range to be used, and of the most appropriate section, so that a high Q value can be obtained. The tube is provided with a longitudinal slot 4 of the same length as the inductance winding, as shown in FIG. 2 if insulated (enameled) wire is used, the insulation thereof should be carefully scraped by the inside of the tube through the slot, so that perfect electrical contact can be effected by the means to be described below.

Figure 3:
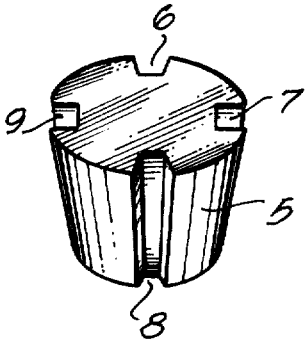
FIG. 3 is a perspective view of an element integrating the antenna.
Figure 4:
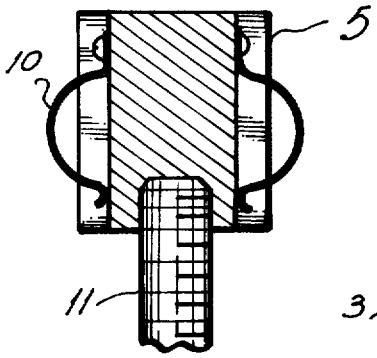
FIG. 4 shows a section of the element of FIG. 3, with other functional parts added thereto.

To form a perfect electrical contact, a cylinder or piston 5 of insulating or metallic material is used (see FIGS. 3 and 4), said cylinder having a slightly smaller diameter than the inside of insulating tube 1. Cylinder 5 has four longitudinal slots 6, 7, 8 and 9, wherein respective slippers 10, of a resilient metal, bronze, etc., are attached to the piston by means of screws. One of these slippers serves as a slide through the slot for establishing contact with the inner side of winding 3, while the three remaining slippers serve as guides to prevent lateral movement of the sliding piston. Cylinder or piston 5 is attached to the end of a threaded rod 11, of a light metallic material, or otherwise insulating with low losses in accordance with the type of antenna, as will be described further, rod 11 being somewhat longer than the stroke to be made within tube 1, in order to scan with the sliding piston the entire length of winding 3. It will be understood that the metallic slipper, once it operates as a fixed contact to piston 5, contacts wire 3 through slot 4 cylinder or piston 5 will not be able to rotate, and will displaceable only longitudinally within the tube.

In order to effect the longitudinal displacement of sliding piston 5 within tube 1 wherein the winding is wound, a second tube 12 of the same material but of a lesser is provided, in the upper end of which there is fixed a metallic bushing-nut 13 into which threaded rod 11 is screwed. Bushing nut 13 serves also as a contact ring (collector) so that, by means of an elastic brush 14 and through the connection 15, it progressively shorts the turns of the winding through the circuit formed by winding 3, piston 5, threaded rod 11 and bushing nut 13, in order to decrease the inductance of the winding from its maximum value (when piston 5 is at its lowermost position) to practically 0 (when piston 5 is at its upper position) wherein in the entire winding is completely short circuited.

At the lower end of the winding, a fixed bushing 16 made of an insulating material is positioned. Bushing 16 has two functions, first, with its reduced bore it guides the screw to establish good contact of brush 14; second, as a stop of the lower stroke for the piston brush, and dependent on the direction of rotation of bushing nut 13 it carries up or down threaded rod 11 driving piston 5 and therefore affects the tuning of the antenna. The upper part of the piston stroke is limited by a metal stop 17 which is in turn the lower end of the rod 2.

Figure 5:
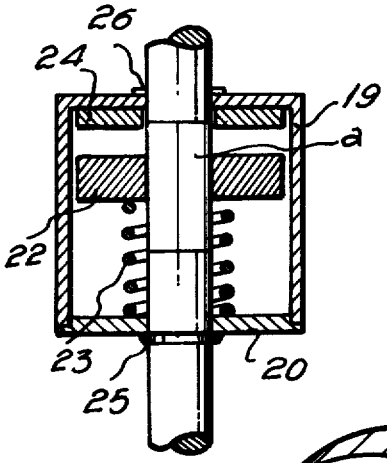
FIG. 5 shows, partially in section, a clutch element integrating the antenna.
Figure 6:
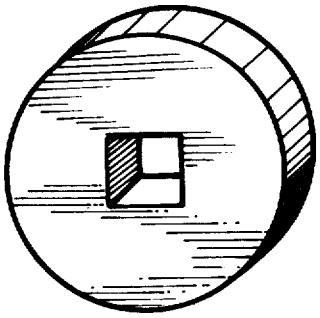
FIG. 6 shows in perspective a tracking guide shown in FIG. 5.

In the lower portion of tube 12 carrying the control bushing 13 of the piston, there is positioned a friction-coupling clutch 18, one embodiment of which is shown in FIG. 5. It consists of a cylindrical cup 19, open on one side and a cover 20, having a round hole for a metal axle 21 serving as a control for the entire tracking mechanism. This axle is of hexagonal or square cross section, as can be seen in FIG. 5, and serves as a guide or drive for a circular member 22 having a square or hexagonal central hole as shown in FIG. 6. This member rotates, driven by the square or hexagonal section of the axle. It is biased in a longitudinal direction by a calibrated spring 23 toward a washer 24, which may be made of leather or any other material, bonded to the bottom of the cup 19, friction-driving the latter and consequently tube 12, in drive relation therewith. Two keys 25 and 26 are provided to keep the assembly positioned. The outer part of the cup is attached to the inside of tube 12 by means of four equally spaced screws 27 which in turn serve as contacts, by means of a brush 28, for a light which flashes whenever the brush touches one of these screws, closing the return circuit of a small bulb located in the remote control and indicating that the inner tube is rotating. When the bulb is off, this indicates both ends of the stroke.

The movement of the motor 29 can be reversed from a control box situated inside the vehicle or other desired location if the system is used in a fixed or moveable location. The worm and ring gear ratio 30, combined with the pitch of the screw which carries the sliding contact on the winding, permits the displacement of the contact on the brush 10 to effect slow and convenient tuning.

An embodiment for use with a lower frequency range is shown in FIG. 7.

The driving means 29 and the winding 3 are the same as in the embodiment just described, the only change being the material for the threaded rod which in the above described case is metallic and in the FIG. 7 embodiment is of an insulating material with low loss. The contact slipper 10 is electrically connected to the rod 2 which in this embodiment is attached to the head of piston 5 and hence is displaced upwardly and downwardly together therewith. The end of the winding 3 is electrically connected to the metallic head of the antenna 31 which inside carries slippers for contact 32 with the rod 2 and therefore, when the sliding piston 5 ascends or descends, it also displaces rod 2, and the sliding piston is then at its uppermost position, i.e., with the total of the winding intermeshed, and rod 2 is also at its maximum length.

Figure 8:
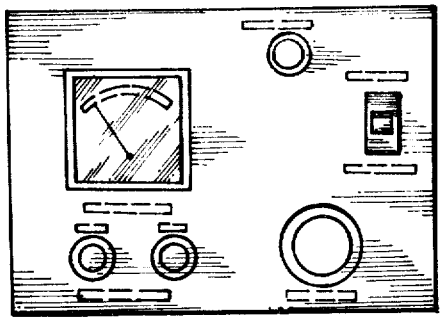
FIG. 8 is a schematic view of a panel for the selection of use of the antenna, and, FIG. 9 shows a longitudinal section of a preferred embodiment of the antenna.

FIG. 8 shows the remote control which uses the normal antenna for broadcasting, with an inverter key to indicate the maximum radiation from the antenna and therefore the correct tuning thereof with a circuit of field intensity measurement.

Figure 9:
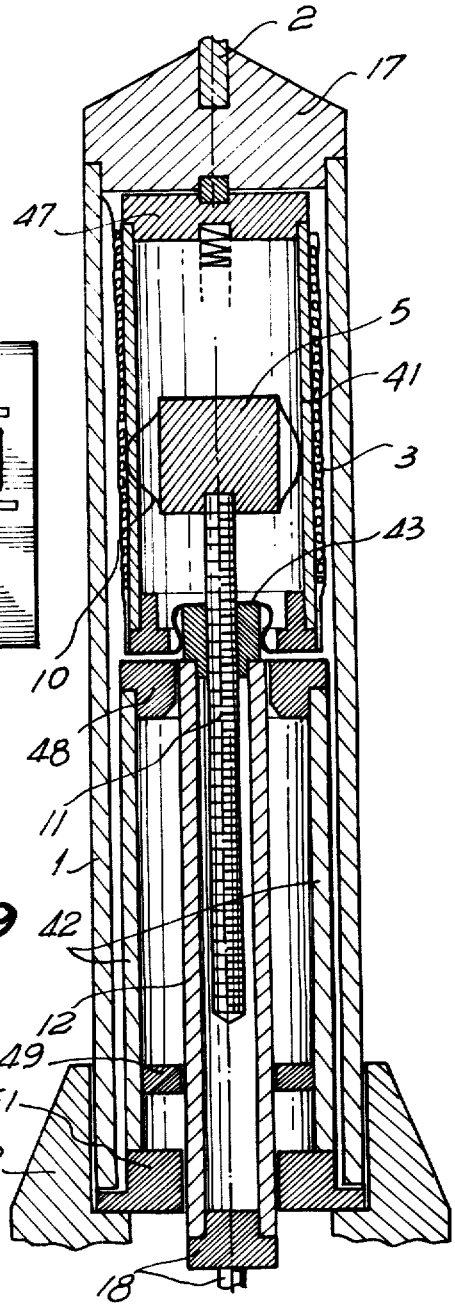

An especially useful variation, particularly in cases wherein the antenna is used in different frequency spectra, is schematically shown in FIG. 9, showing a modification consisting in the use of concentric tube supports. The antenna, as previously described, comprises a supporting tube 1, containing a tube guide 42 for the nut-carrying tube 12, which displaces the sliding piston 5, and a supporting tube 41 for the copper wire winding, said two tubes being of substantially equal diameters less than the diameter of the supporting tube 1 of the antenna containing them. These tubes are firmly maintained in position, against rotation or displacement, by means of covers and resilient means 17 and 47. The tube guide 42 contains interior annular supporting means or bearings 48, 49 and 51 for the rotating nut-carrying tube 12 which, is coupled to a motor by clutch means 18, as explained above.

The supporting tube 41 for the winding comprises a longitudinal slot 4, identified in FIG. 2 through which the resilient contact means 10 is attached to the sliding piston 5 is displaced.

It will be clear from the description of the supporting tubes that different types of wire and different numbers of turns can be employed, so that the frequency range of use of the antenna may be varied merely by changing the tube.

Having described my invention and one of the manners by which it may be carried out, I claim as my exclusive right:

1. A continually adjustable frequency antenna, comprising (a) a supporting tube connected to an antenna and having a winding on its exterior;

(b) a sliding piston mounted for upward and downward movement within said supporting tube and having means thereon preventing it from rotating with respect to said supporting tube;

(c) a threaded rod attached by one of its ends to said sliding piston;

(d) a second tube within said supporting tube and receiving said threaded rod when said sliding piston moves downwardly;

(e) means for rotatably driving said second tube;

(f) said threaded rod being moved from its uppermost to its lowermost position by a rotating nut located at one end of said second tube.

2. An antenna according to claim 1, comprising a resilient slipper on said sliding piston engaging within a longitudinal slot in said supporting tube and contacting the inner side of said winding.

3. An antenna according to claim 1, comprising a friction coupling for rotatably driving said second tube, whereby at the end of the strokes said sliding piston continues rotation of said driving means.

4. An antenna according to claim 1, wherein said driving means comprises a reversible electric motor and a gear train.

5. An antenna according to claim 1, comprising switch means for reversing the direction of the motor and displacement of said sliding piston, and means on said second tube for actuating an indicator light upon its rotation.

6. An antenna according to claim 1, wherein said supporting tube is arranged within an outer tube, said second tube being arranged within a tube guide means positioned within said outer tube, in contact with and below said supporting tube, said supporting tube and said second tube being fixed against rotation and displacement.

* * * * *